United States Patent [19]

Greenslade

[11] Patent Number: 5,054,644

[45] Date of Patent: Oct. 8, 1991

[54] BOX

[75] Inventor: Robert C. Greenslade, Bristol, United Kingdom

[73] Assignee: Nomix Manufacturing Company Limited, Bristol, United Kingdom

[21] Appl. No.: 587,396

[22] Filed: Sep. 25, 1990

[30] Foreign Application Priority Data

Sep. 26, 1989 [GB] United Kingdom ..... 892689

[51] Int. Cl.[5] ..... B65D 5/54; B65D 5/74

[52] U.S. Cl. ..... 220/403; 206/620; 220/465; 220/462

[58] Field of Search ..... 220/403, 404, 462, 465, 220/541; 206/620, 621.2

[56] References Cited

U.S. PATENT DOCUMENTS

| | | | |
|---|---|---|---|
| 3,054,549 | 9/1962 | Humphrey | 220/465 |
| 3,108,732 | 10/1963 | Curie et al. | 220/465 |
| 3,206,094 | 9/1965 | Humphrey et al. | 220/462 |
| 3,233,817 | 2/1966 | Casady | 220/403 |
| 3,253,764 | 5/1966 | Goetschius et al. | 220/465 |
| 4,815,631 | 3/1989 | Eeg et al. | 220/462 |

FOREIGN PATENT DOCUMENTS

| | | | |
|---|---|---|---|
| 860129 | 2/1961 | Fed. Rep. of Germany . | |
| 3802793 | 8/1989 | Fed. Rep. of Germany . | |
| 3829606 | 3/1990 | Fed. Rep. of Germany | 220/465 |
| 922960 | 4/1963 | United Kingdom | 206/621.3 |

*Primary Examiner*—Gary E. Elkins

*Attorney, Agent, or Firm*—Merchant, Gould, Smith, Edell, Welter & Schmidt

[57] ABSTRACT

A box has a flnaged outlet fitting 48 engaged in an aperture defined by recesses 26, 42 in inner and outer panels 16, 30. The outer panel 30 can be moved from a buckled configuration (FIG. 3) to a flat configuration (FIG. 4) to cause the recess 42 to engage the fitting 48. Locking tabs 38 are insertable into slots defined between side wall panels of the box, in order to prevent movement of the outer panel 30 from the flat to the buckled configuration.

9 Claims, 3 Drawing Sheets

BOX

This invention relates to a box made from a rigid blank of stiff material and is particularly, although not exclusively, concerned with a cardboard box for receiving a liquid-filled flexible bag containing, for example, herbicide.

It is known for herbicides to be packaged in a flexible bag provided with an outlet fitting, the bag being accommodated in a cardboard box. As supplied to the user, the outlet fitting is situated within the box, behind a tear-out portion. The user removes the tear-out portion, revealing an aperture providing access to the outlet fitting. The user grasps the outlet fitting and manipulates it into a position in which it is retained by the wall of the aperture.

This operation is somewhat fiddly to perform, and it has been proposed that packages of this type could be supplied to the end user with the outlet fitting already engaged in an aperture in the wall of the box. However, difficulties have been experienced in locating the fitting securely in the aperture during construction of the package.

According to the present invention there is provided a box made from a rigid blank of stiff material, having a closure including an aperture for receiving a flanged fitting, the closure comprising an inner panel and an outer panel provided with openings which cooperate to define the aperture, the opening in the outer panel comprising a recess extending from an edge of the outer panel, the outer panel being hinged to a side wall of the box and being creased to enable it to be displaced from a buckled configuration, in which the region of the outer panel having the recess lies substantially flat on the inner panel with the recess at least partially disengaged from the fitting, to a flat configuration, in which the entire outer panel lies substantially flat on the inner panel with the recess fully engaging beneath the flange of the fitting, the outer panel having a locking tab which, when the outer panel is in the flat configuration, is insertable into a slot defined between panels of the box, the locking tab, when inserted, preventing displacement of the outer panel from the flat configuration to the buckled configuration.

Preferably, the outer panel is hinged to the side wall at an edge opposite the edge in which the recess is provided.

The outer panel may be provided with crease lines, extending parallel to the hinge line, the outer panel then folding about the crease lines in order to assume the buckled configuration.

The slot into which the locking tab is insertable is preferably provided in a side wall which extends perpendicular to the line about which the outer panel is hinged. The slot may be defined between two panels making up the respective side wall, these panels being spaced apart by a further panel having an edge which defines a lengthwise end of the slot.

For a better understanding of the present invention, and to show how it may be carried into effect, reference will now be made, by way of example, to the accompanying drawings in which.

Figure 1:
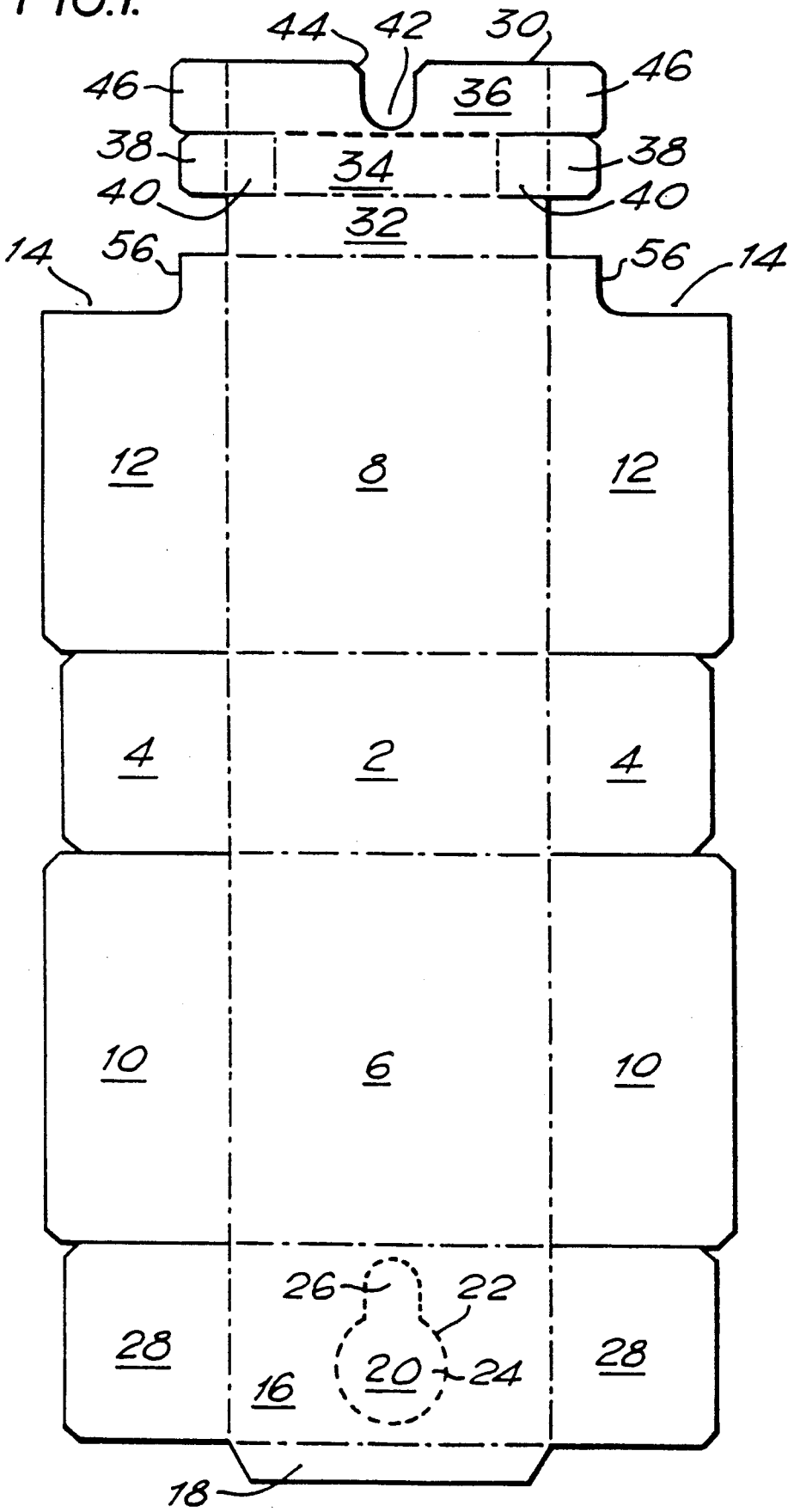
FIG. 1 shows a blank for a box.

The blank shown in FIG. 1 is made from stiff material, such as corrugated cardboard. In FIG. 1, cuts are represented by continuous lines, perforations are represented by dashed lines, and creases are represented by chain-dotted lines.

The blank comprises a base panel 2 to which are hinged base flaps 4 and front and rear panels 6 and 8. The front panel 6 carries outer side panels 10, and the rear panel 8 carries inner side panels 12. The panels 12 have cut-out regions 14 which terminate at edges 56. At its edge away from the base panel 2, the front panel 6 has an inner closure panel 16 provided with a glue flap 18 and a tear-out portion 20, defined by perforations 22. The tear-out portion 20 has a circular region 24, from which extends an elongate region 26. The inner closure panel 16 also has two end flaps 28.

The rear panel 8 carries an outer closure panel 30 comprising three strips 32, 34 and 36. The intermediate strip 34 carries locking tabs 38 which are articulated to the intermediate panel 34 by articulation panels 40.

The outer strip 36 is provided with a slot 42 having a tapering entry region 44. The outer strip 36 also has closure tabs 46.

To erect a box from the blank of FIG. 1, the base flaps 4 are folded upwardly about the base panel 2, followed by the front and rear panels 6 and 8. The side panels 12, and then the side panels 10, are folded over the flaps 4, the outer side panels 10 being glued to the inner side panels 12. A filled container, for example, of herbicide, is then placed in the box, and the inner closure panel 16 is folded down over the container and the glue tab 18 bonded to the rear panel 8. The tear-out portion 20 is then removed. The resulting configuration is shown in FIG. 2.

Figure 2:
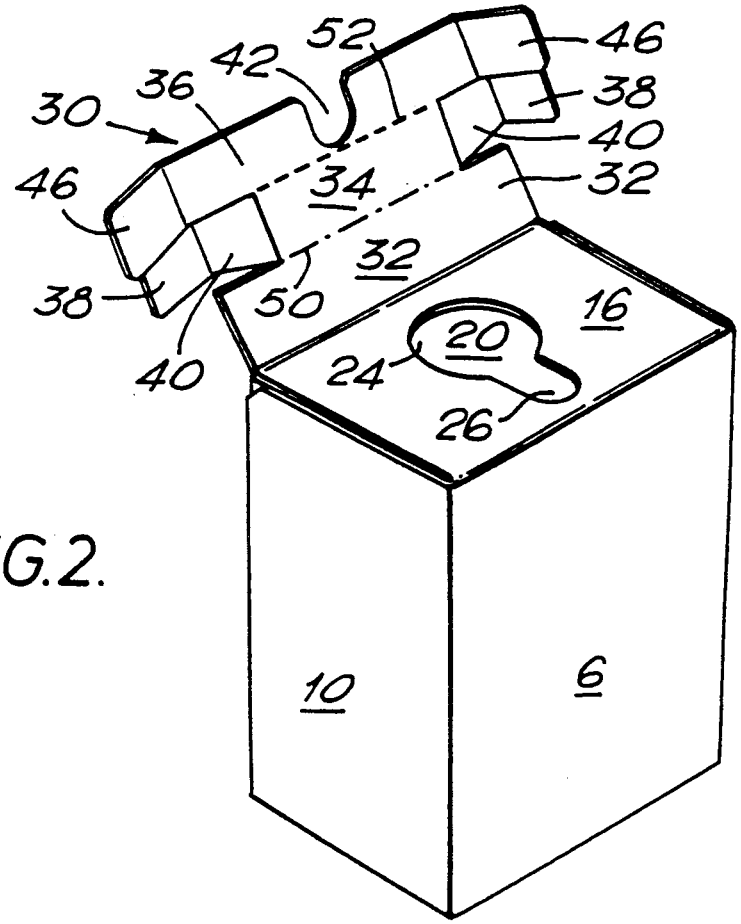
FIG. 2 shows a box erected from the blank, with an end closure partially formed.
Figure 3:
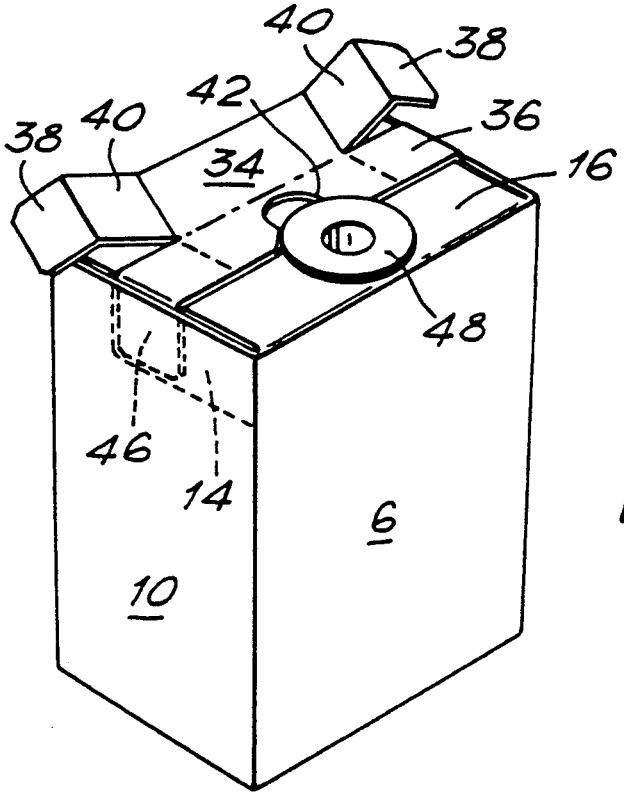
FIGS. 3 and 4 show successive steps in the formation of the end closure.

The bag of herbicide has an outlet fitting including a flange 48 (FIG. 3) which is of approximately the same diameter as the circular region 24 of the aperture left by removal of the tear-out portion 20 (in FIG. 2, this aperture also has the reference 20). The flange 48 is pulled through the circular region 24 and the fitting as a whole is pushed from the circular region 24 into the elongate region 26 so that the flange 48 lies on the surrounding material of the inner closure panel 16. When this has been done, the outer closure panel 30 is buckled by folding about the hinge line 50 between the strips 32 and 34 and the hinge line 52 between the strips 34 and 36. The strip 36 can then be laid substantially flat on the inner closure panel 16, but approximately halfway across its width. The tabs 46 can be inserted into the cut-out regions 14, which form spaces, in the form of slots, between the flaps 28 and the outer side panel 10. The resulting configuration is shown in FIG. 3.

Figure 4:
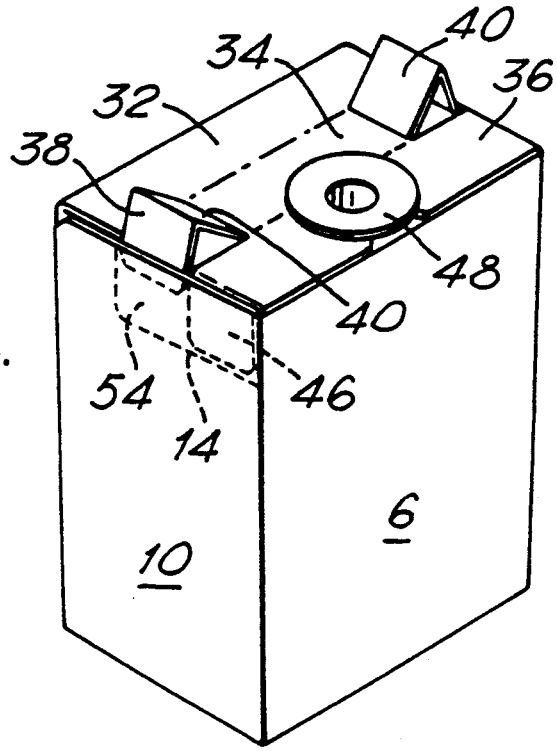
Figure 5:
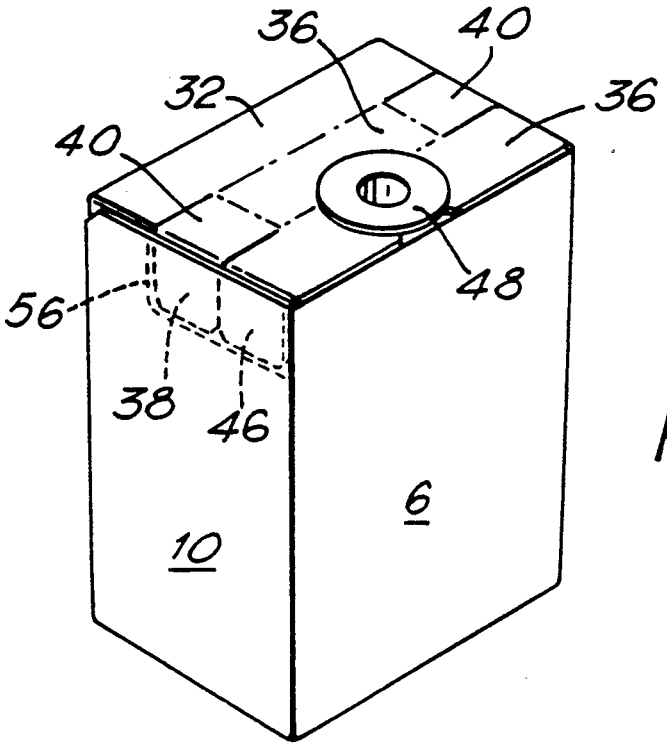
FIG. 5 shows the completed box.

The strip 36 is then pushed in the direction away from the hinge between the outer closure panel 30 and the rear panel 8 so that the recess 42 engages the outlet fitting, with the strip 36 being inserted between the inner closure panel 16 and the flange 48. This movement takes the tabs 46 to a position in the cut-out regions 14 adjacent the front panel 6, leaving a slot 54 on each side, into which the locking tabs 38 can be inserted, as shown in FIG. 4. The fully erected box is shown in FIG. 5. It will be appreciated that the edges 56 of the inner side panels 12, which edges define the cut-away regions 14, prevent movement of the outer strip 36 in the direction away from the front panel 6, by virtue of their engagement with the locking tabs 38. Consequently, the outer closure panel 30 is held securely in position, engaging the outlet fitting under the flange 48. If the outlet fitting is to be released, it is necessary first to withdraw the locking tabs 38, by pivoting them about the articulating panels 40, so that the upper closure panel 30 is free to buckle about the hinge lines 50 and 52. The box construction as described, therefore, provides a secure, and yet releasable, engagement between the outlet fitting and the box itself, using a minimum of glued connections.

I claim:

1. A box made from a rigid blank of stiff material, having a closure including an aperture for receiving a flanged fitting, the closure comprising an inner panel and an outer panel provided with openings which cooperate to define the aperture, the opening in the outer panel comprising a recess extending from an edge of the outer panel, the outer panel being hinged to a side wall of the box and being creased to enable it to be displaced from a buckled configuration, in which the region of the outer panel having the recess lies substantially flat on the inner panel with the recess at least partially disengaged from the fitting, to a flat configuration, in which the entire outer panel lies substantially flat on the inner panel with the recess fully engaging beneath the flange of the fitting, the outer panel having a locking tab which, when the outer panel is in the flat configuration, is insertable into a slot defined between panels of the box, the locking tab, when inserted, preventing displacement of the outer panel from the flat configuration to the buckled configuration.

2. A box as claimed in claim 1, in which the outer panel is hinged to the side wall at an edge opposite the edge in which the recess is provided.

3. A box as claimed in claim 1 in which the outer panel is provided with crease lines, extending parallel to the hinge line, the outer panel then folding about the crease lines in order to assume the buckled configuration.

4. A box as claimed in claim 3, in which the crease lines divide the outer panel into three regions, comprising a first region in which the recess is situated, a second region which is hinged to the side wall and an intermediate region, disposed between the first and second regions, carrying the locking tab.

5. A box as claimed in claim 1, in which the locking tab is articulated to the outer panel by an articulation panel, the articulation panel being connected to the locking tab and to the outer panel at respective hinge lines which are parallel to each other.

6. A box as claimed in claim 1, in which the slot into which the locking tab is insertable is provided in a side wall which extends perpendicular to the side wall to which the outer panel is hinged.

7. A box as claimed in claim 1, in which the panels defining the slot are spaced apart by a further panel having an edge which defines a lengthwise end of the slot.

8. A box as claimed in claim 1, in which two locking tabs are provided, disposed on opposite sides of the outer panel.

9. A box as claimed in claim 1, which contains herbicide.

* * * * *